United States Patent [19]
Bulloch et al.
[11] 4,298,681
[45] * Nov. 3, 1981

[54] N,N DISUBSTITUTED P-PHENYLENEDIAMINE PHOSPHATES TO FORM A COLOR DEVELOPER WORKING SOLUTION, A COLOR DEVELOPER CONCENTRATE CONTAINING SUCH A PHOSPHATE AND A METHOD OF USING SAID WORKING SOLUTION FOR COLOR DEVELOPMENT OF COLOR FILM

[75] Inventors: David K. Bulloch, Hillsdale; Hong Z. Kim, Bergenfield, both of N.J.

[73] Assignee: Philip A. Hunt Chemical Corp., Palisades Park, N.J.

[ * ] Notice: The portion of the term of this patent subsequent to Apr. 1, 1992, has been disclaimed.

[21] Appl. No.: 335,343

[22] Filed: Feb. 23, 1973

[51] Int. Cl.[3] ..... G03C 5/30
[52] U.S. Cl. ..... 430/466; 430/467; 430/484
[58] Field of Search ..... 96/66 R, 66.1, 55, 22, 96/56.6; 260/556 A; 430/466, 467, 484

[56] References Cited

U.S. PATENT DOCUMENTS

| | | | |
|---|---|---|---|
| 3,297,760 | 1/1967 | von Hessert et al. | 96/66 R |
| 3,419,395 | 12/1968 | von König et al. | 96/66 R |
| 3,574,619 | 4/1971 | Surash | 96/66.1 |
| 3,656,950 | 4/1972 | Bent et al. | 96/66 R |
| 3,658,525 | 4/1972 | Bent et al. | 96/66 R |
| 3,664,838 | 5/1972 | Amano et al. | 96/66 R |
| 3,875,227 | 4/1975 | Kroll et al. | 96/55 |

*Primary Examiner*—Mary F. Downey
*Attorney, Agent, or Firm*—Kirschstein, Kirschstein, Ottinger & Cobrin

[57] ABSTRACT

An N,N, disubstituted p-phenylenediamine salt of a phosphoric acid selected from the group consisting of ortho-phosphoric acid, pyrophosphoric acid and polyphosphoric acid. Such a phosphate is incorporated as a color developing agent in a liquid packaged developer concentrate which subsequently is mixed with other materials contained in a multi-package receptacle and the mixture is diluted with water to form a color developer working solution (bath) for developing a colored film. The developer concentrate has the advantage that the color developing agent therein does not tend to deteriorate upon standing, as do present-day widely used commercial N,N, disubstituted p-phenylenediamine color developing agents in developer liquid concentrates, e.g. 4-amino-N-ethyl, N-beta methanesulfonamidoethyul-m-toluidene sesqui-sulfate monohydrate and 4-amino-N-ethyl, N-beta methanesulfonamidoethyl-m-toluidene hydrochloride; nor do the new phosphate color developing agents require the presence in the developer liquid concentrate of an anti-oxidant such as a sulfite or ascorbic acid, as do the present-day commercial color developing agents, although the presence of such anti-oxidants with the new color developing agents is not harmful and, indeed, is of some slight assistance. The new color developer liquid concentrate may contain conventional photographic adjuvants and is characterized by its ability to incorporate large percentages of the color developing agent without rendering the concentrate physically unmanageable for packaging and admixture with other materials to form a working color developer solution whereby the volume and weight of a kit employing such a concentrate is reduced thereby lowering production, storage and shipping costs. The new color developing agent, because of the minimal deterioration upon standing, provides true color values upon developing, which values are as good as those obtainable with freshly prepared presently used color developing agents that are not of the phosphate type. The invention also embraces the use of the new color developing agent for color developing of colored film.

7 Claims, No Drawings

N,N DISUBSTITUTED P-PHENYLENEDIAMINE PHOSPHATES TO FORM A COLOR DEVELOPER WORKING SOLUTION, A COLOR DEVELOPER CONCENTRATE CONTAINING SUCH A PHOSPHATE AND A METHOD OF USING SAID WORKING SOLUTION FOR COLOR DEVELOPMENT OF COLOR FILM

BACKGROUND OF THE INVENTION

1. Field of the Invention

N,N, disubstituted p-phenylenediamine color developing agents, their incorporation as a principal functional component of a liquid packaged developer concentrate, their incorporation in color developing working solutions (baths) and their use in the color development of colored film.

2. Description of the Prior Art

The formation of colored negative or positive images from exposed sensitized silver halide color emulsions is a demanding process which requires a high degree of purity in the color developing solutions. The chemistry and physics of the process are described by J. R. Thirtle and D. M. Zwick in Kirk-Othmer "Encyclopedia of Chemical Technology", Volume 5, pages 812–845 (2nd edition). The process is applicable to the developing of photographic color negatives, photographic color positives, photographic color plates and colored cinematographic films. The developers currently and for many years past used in the trade to process such emulsions contain as the color developing agent N,N disubstituted p-phenylenediamines. In the course of color development, the color developing agent reacts with phenolic or active methylene couplers that are incorporated in sundry layers of the emulsion on a transparent base or paper and forms non-diffusing dyes that constitute the final image.

Such color developing agents, when in contact with exposed silver halide, distributed in three separate emulsion layers, undergo oxidation to quinone diimines which, in turn, condense with the three different color couplers, each of which is present in a different emulsion layer. The amount of quinone diimine formed is directly proportional to the amount of silver halide that has been exposed and, therefore, determines the amount and, hence, the intensity, of dye that is formed. This process is known as oxidative coupling. The combination of the layers of yellow, cyan and magenta dyes in amounts determined by the exposed silver halide can be made to reproduce with a high degree of faithfulness the colors of the photographed subject.

Any degradation of the color developing agent affects the amount of dye formed and the degradation products may adversely affect the color of the dye formed and also the degraded color agent may diffuse throughout a given layer to develop color in non-exposed areas. It will be appreciated by those skilled in the art that N,N, disubstituted p-phenylenediamines as color developing agents are characterized by their ability to condense with color couplers in the immediate vicinity of exposed silver halide grains and not to diffuse, whereas degradation products may not be characterized by such non-diffusibility and, hence, can result in non-selective dye formation.

From a practical point of view, the choice of developing agents is limited because of the characteristics demanded of the dyes, among others, optimum spectral characteristics and resistance to fading, bearing in mind that the most widely distributed color films are made by and under the control of a single manufacturer, so that the color developing agents are specifically tailored to the existing color couplers present in such emulsions in order to form the correct dyes, or because of characteristics demanded of the color developing agents such as non-allergenicity.

One particular N,N, disubstituted p-phenylenediamine color developing agent has gained wide acceptance in the trade and is the color developing agent recommended by the single manufacturer for color developing its color film. This is 4-amino-N-ethyl, N-beta methanesulfonamidoethyl-m-toluidene, hereinafter denominated as AEMT. This compound also is known as 4-amino, 3-methyl,N-ethyl,N-beta methanesulfonamidoethyl aniline. AEMT has the following structural formula:

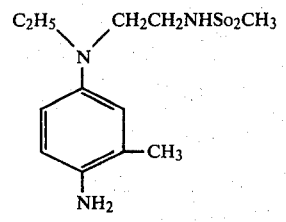

As a sesqui-sulfate monohydrate of the aforesaid free base, the color developing agent is marketed under the designation CD-3 and is used in a majority of color photographic processes developed by Eastman Kodak Company. Other N,N, disubstituted p-phenylenediamine color developing agents have been proposed, but none has found as wide an acceptance as CD-3 and, in the present market, CD-3 is the color developing agent of choice despite the fact that other N,N, disubstituted p-phenylenediamines are well known for the sample purpose. Typical of other N,N, disubstituted p-phenylenediamine color developing agents that form non-diffusing dyes with phenolic and active methylene couplers are N,N diethyl-p-phenylenediamine monohydrochloride [known in the trade as CD-1]; 4-amino-3-methyl-N-ethyl-N-beta hydroxyethyl aniline sulfate [the free base, as distinguished from the sulfate salt, is known as AMEHEA, the sulfate salt is known in the trade as CD-4]; 2-amino-5-diethyl-amino-toluene [known as ADAT, the hydrochloride salt is known in the trade as CD-2]; and similar N,N, disubstituted p-phenylenediamine color developing agents such, for example, as those disclosed in U.S. Pat. Nos. 2,552,241; 2,566,271 and 3,658,525, and in an article entitled "CHEMICAL CONSTITUTION, ELECTROMECHANICAL, PHOTOGRAPHIC AND ALLERGENIC PROPERTIES OF p-AMINO-N-DIALKYL-ANILINES" (sic) published in the Journal of the American Chemical Society, Volume 73, Pages 3100–3125 (1951).

As mentioned above, the color developing agent of primary commercial interest is, and for some time past has been, the sesqui-sulfate monohydrate of AEMT. This salt is itself a color developing agent. However, it does not constitute, as such, a color developer, that is to say, a working bath for the color development of a color film, but is a necessary ingredient of a color developer. In some commercial color processes it is the practice to segregate different constituents of a working color developer bath into separate components (compositions), each of which is concentrated as far as is practical, and each of which is liquid to facilitate mixing and dilution with water (upon occasion some of the components may be dry), and each of which is compartmented, that is to say packaged in a receptacle separate from other packaged components, all of the packaged components of a developer usually being contained in a single box. Any given component need not be, and usually is not, composed of a single ingredient such, for example, as a color developing agent. It is common, for example, to include a liquid solvent which may be water and/or an organic solvent and/or a solubilizing agent and/or a mixture of different liquids as an ingredient of each component. The organic solvent and/or solubilizing agent, if present, may have as their sole function that of a carrier or they also may have a photographic function such, for example, as boosting the dye formed when the color developing agent reacts with a color coupler. Additionally, there are various adjuvants which are used in a working color developer bath, examples of which are pH buffering systems, preservatives, sequestrants, anti-foggants, enhancers, and the like. Some of these require different solvent systems and, for such reason, are separately compartmented. Others tend to be unstable when kept for periods of time in the same compartment with different ones of the compounds used. Others have a tendency to react with different ones of the compounds used. Others require the presence of co-solvents, etc. Hence, separate compartmenting of different components is an accepted practice in the art. The principles involving separate compartmentation and concentrating and allocation of different compounds to different compartments, as well as the concept of mixing the different compartmented compounds and diluting the same with water at the time of use, are well known.

In connection with the color developing agent of principal interest, CD-3, the color developing component which includes the color developing agent is, in its concentrated form, dissolved in water and pre-packaged; subsequently, the concentrated color developing component is, as indicated above, added to other concentrated components and diluted with water to form a working bath. It has been found that when CD-3 is used, a protective agent must be employed in the color developing component (concentrate) containing the same to prevent immediate initiation of the decomposition of the color developing agent by aerial oxidation. Conventionally, this has been done by adding an alkaline bisulfite or sulfite, usually an alkaline metal bisulfite or sulfite, to the color developing component as an element thereof. The term "alkaline" includes such moieties as alkali metals, quaternary ammoniums, amines, etc.

A color developing concentrated component so composed and stored in a fully closed container undergoes slow decomposition and this decomposition is accelerated if the concentrate has its temperature raised by storage in a warm or even hot environment. Such slow decomposition is inevitable in commercial practice because, after the concentrate is prepared at a factory, it is conventional to store the same at a warehouse near the point of manufacture, then to ship it to distribution points where, again, it is stored until withdrawn upon order. Thereafter, it is trucked to a retail outlet where it is put in a back room for a considerable time, after which it is moved onto retail shelves where it awaits purchase by members of the public or by photographic processors. The prevailing temperature at each of its points of repose obviously is beyond the control of the manufacturer and, because of extremely wide geographic distribution, the color developing concentrate inevitably is subjected to warm and hot environments so that decomposition, if it is to take place, must occur. The exact nature of such decomposition is not fully understood by the present inventors, but it is theorized that it involves reactions between the sulfur/oxygen moieties present in the concentrate which, in turn, may in part turn upon the proportions between the color developing agent and the preservative. In any event, the photographic consequences of the decomposition are easily measured and it is these consequences which limit the shelf life of such concentrates, to wit, of a CD-3/sulfite concentrate.

When a container having such a CD-3/sulfite concentrate is opened and exposed to air, two disadvantageous reactions occur in addition to the previous in-package slow decomposition. One of these further reactions is that the liquid concentrate immediately evolves sulfur dioxide gas and, at the same time, the sulfite (or bisulfite) in the solution starts to decompose continuously and rapidly at a rate much faster than decomposition took place in the closed container. This decomposition proceeds until the sulfite or bisulfite is fully depleted. The second reaction is that exposure to air causes oxidation of the color developing agent. Initially, decomposition is comparatively slow due to the protective effect of the sulfite or bisulfite, but as this anti-oxidant depletes, the oxidation of the developing agent accelerates quite quickly until the decomposition proceeds very rapidly when the bisulfite/sulfite in the container diminishes to zero.

The decomposition of the color developing agent leads to the production of false colors, non-selective dye formation and fog in any color emulsion which is developed therewith. The evolution of sulfur dioxide gas from the concentrate when the container is opened is considered highly objectionable due to both the sharp pungent odor of the gas and to its lacrimating action.

The decomposition of the color developing agent and of the preservative could be somewhat reduced if the color developing component were not highly concentrated, but manufacturers and users find it advantageous, for reasons mentioned earlier, to make and use a color developing component which is as concentrated as it is reasonably possible to make. The concentration is limited practically by factors such as increase in viscosity to the point that the concentrate cannot be poured out of its container with ease, or there is too much of a tendency to retain some of the concentrate as a thick film on the walls of the container, or the viscosity becomes so high that dilution with water to form the working bath becomes overly difficult. Increase in concentration is also limited by the decomposition just discussed.

SUMMARY OF THE INVENTION

1. Purposes of the Invention

It is an object of the invention to provide a new type of color developing agent which eliminates some of the foregoing drawbacks and substantially reduces others.

It is another object of the invention to provide a new chemical compound having as its presently-known primary use the employment thereof as a color developing agent.

It is another object of the invention to provide a color developing composition in concentrated liquid form having as a novel component thereof a unique new color developing agent.

It is another object of the invention to provide a color developing working bath which employs the new type of color developing agent in lieu of the previous type of color developing agents but which can be used in place of such former type of color developing agents without having any deleterious photographic effects.

It is another object of the invention to provide a method of color developing a color emulsion in which method the new type of color developing agent is employed.

Other objects of the invention in part will be obvious and in part will be pointed out hereinafter.

2. Brief Description of the Invention

The new color developing agent is an N,N, disubstituted p-phenylenediamine salt of a phosphoric acid selected from the group consisting of orthophosphoric acid, pyrophosphoric acid and polyphosphoric acid containing the equivalent of from about 105% to about 115% orthophosphoric acid. Such salt is far more stable than sulfuric and hydrochloric acid salts of N,N, disubstituted p-phenylenediamines when incorporated in aqueous concentrates. The new salt is quite stable even in the absence of anti-oxidants such as ascorbic acid, sulfites and bisulfites, although its stability is slightly improved by the presence of such antioxidants. Working baths containing the new color developing agents produce true color values and, where the concentrates are stored for a considerable period of time prior to use, the deterioration thereof is so minimal that when subsequently incorporated into a working color developer bath, the differences in colors are so slight as to be acceptable and, indeed, are considerably less than the differences in colors encountered with previous color developing agents used either with or without an antioxidant.

The new salts may be formed by reacting an N,N, disubstituted p-phenylenediamine free base with an acid of the type described, the acid preferably being somewhat in excess, an accepted range being one mol to 3 mols of acid to one mol of the free base, and a preferred ratio being about a 5% excess of the acid above the stoichiometric ratio. The stability of the salt in a concentrated aqueous solution is somewhat increased where the acid is present in excess of the stoichiometric amount. The concentrate is in the form of an aqueous solution of the new color developing agent. However, the solution also may include a preservative or other adjuvants which can be dissolved in water and which will not react with one another or with the color developing agent. Additionally, co-solvents may be included both for their usefulness in the working bath ultimately to be made and to enable additional compounds to be included in the concentrate, so that the number of packages, the contents of which are to be mixed together and diluted in water to make a working solution, can be kept to a minimum. The working bath made with the use of the concentrate containing the new color developing agent is employed for color developing in a working bath in a manner which does not differ from that practiced with working baths presently employed using other color developing agents except, of course, that the fidelity of color reproduction using the new color developing agent is considerably less degraded by storage of the concentrate prior to use. It also is within the scope of the present invention to employ derivatives of the new type of concentrate, to wit, derivatives of phosphate salts of N,N, disubstituted p-phenylenediamine, and specifically, alcoholates of such salts, these being described and claimed in application Ser. No. 335,341 filed by Harry Kroll and Alderic R. Therrien on Feb. 23, 1973 for ALCOHOLATES ORTHOPHOSPHATE SALTS OF 4-AMINO, 3-METHYL, N-ETHYL, N-BETA METHANESULFONAMIDOETHYL ANILINE, now U.S. Pat. No. 3,875,227 granted Apr. 1, 1975. This type of derivative likewise is soluble in water and can be used whenever the phosphate salts themselves can be employed. A maximum workable concentration for the new salts in aqueous solution is about 50% by weight.

The invention consists in the compounds, compositions, concentrates and methods which will be hereinafter described and of which the scope of application will be indicated in the appended claims.

PREFERRED EMBODIMENTS OF THE INVENTION

The primary novelty of the present invention resides in the unique photographic characteristics of N,N, disubstituted p-phenylenediamine salts of a phosphoric acid selected from the group consisting of orthophosphoric acid, pyrophosphoric acid and polyphosphoric acid containing the equivalent of from about 105% to about 115% orthophosphoric acid and water-soluble derivatives of such salts. Their unique characteristics make these salts highly advantageous for use as a color developing agent, particularly in a concentrated aqueous solution thereof, so that the same can replace N,N, disubstituted p-phenylenediamine salts in present-day commercial use, specifically as a replacement for CD-3 which is the sesqui-sulfate monohydrate salts of 4-amino-N-ethyl, N-beta methanesulfonamidoethyl-m-toluidene.

A suitable method of preparation for the new color developing agent is, at ambient temperature and pressure, to dissolve 42.5 grams of 85% orthophosphoric acid (a water solution containing 85% by weight of orthophosphoric acid) in 100 milliliters of water, and then, at ambient temperature and pressure, to dissolve in said dilute water solution of phosphoric acid 100 grams of AEMT, adding enough water for the purpose of further dilution to make up 200 milliliters of solution. The amount of phosphoric acid employed is slightly in excess of the amount required stoichiometrically to neutralize the free base AEMT. The AEMT and additional water can be added gradually over a period of a few minutes or they can be added all at once. Desirably, the water solution of the two compounds is stirred to facilitate the neutralization reaction. There thus is formed a concentrate subsequently, referred to as I, which contains 50% weight per unit volume of AEMT on a free base basis. Reference is made to this particular concentration because it subsequently will be compared with similar concentrations of AEMT utilized in the form of CD-3, to wit, a sesqui-sulfate monohydrate of AEMT both with and without an anti-oxidant and with a concentrate of an alcoholate of the new phosphate salt.

The foregoing example is exemplificative of a suitable method for preparing a color developing agent pursuant to the present invention. AEMT is only one of many N,N, disubstituted p-phenylenediamines which can be similarly prepared in the form of a phosphate salt by the foregoing method. Other N,N, disubstituted p-phenylenediamines have been mentioned previously and constitute N,N, diethyl-p-phenylenediamine; 4-amino-3-methyl-N-ethyl-N-beta hydroxyethyl aniline; 2-amino-5-diethyl-aminotoluene; and N,N, disubstituted p-phenylenediamine color developing agents such as those disclosed in U.S. Pat. Nos. 2,552,241; 2,566,271 and 3,658,525, and in an article entitled "CHEMICAL CONSTITUTION, ELECTROMECHANICAL, PHOTOGRAPHIC AND ALLERGENIC PROPERTIES OF p-AMINO-N-DIALKYLANILINES" (sic) published in the Journal of the American Chemical Society, Volume 73, pages 3100–3125 (1951).

The same reaction method between an acid and an N,N, disubstituted p-phenylenediamine is practiced when preparing the other phosphate salts of N,N, disubstituted p-phenylenediamine color developing agent such, for instance, as pyrophosphoric salts and polyphosphoric salts of N,N, disubstituted p-phenylenediamines. It has been found that where the aqueous concentrate of N,N, disubstituted p-phenylenediamine phosphate salts does not exceed 50% weight per unit volume, the concentrate is sufficiently fluid for easy pouring out of a container in which the same has been stored and is readily dilutable by mixing with water and other concentrates to form a working color developing solution. However, with phosphate salts, as the concentration of the salt rises from 50% to 60% the concentrate starts to become viscous and, indeed, at 60% might be considered to be too viscous for marketability, although the same can be used, pursuant to the present invention, as, for example, by flushing out with water the container in which the concentrate is stored. Indeed, the concentration may even go up to as high as 65% with usable commercial results.

The new salt also may be used in the form of a derivative and, specifically, an alcoholate derivative, typical derivatives being an N,N, disubstituted p-phenylenediamine phosphate alcoholates wherein the N,N, disubstituted p-phenylenediamine is AEMT and wherein the alcoholate is of a lower aliphatic alcohol selected from the group consisting of methyl alcohol, ethyl alcohol, n-propyl alcohol and isopropyl alcohol, the alcoholate of the salt having the formula

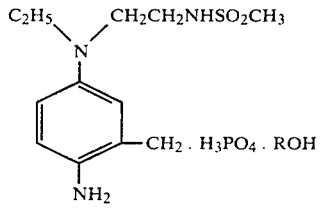

where R is $CH_3$, $C_2H_5$, $CH_3CH_2CH_2$ or

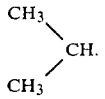

AEMT phosphate alcoholates and their method of preparation are described and claimed in co-pending application Ser. No. 335,341 filed Feb. 23, 1973 for "ALCOHOLATES OF ORTHOPHOSPHATE SALTS OF 4-AMINO, 3-METHYL, N-ETHYL, N-BETA-METHANESULFONAMIDOETHYL ANILINE" by Harry Kroll and Alderic R. Therrien now U.S. Pat. No. 3,875,227.

A typical color developer formulation for a working color developer bath using the concentrate of the present invention hereinabove referred to as I (the only constituents of this concentrate are the new color developing agent, to wit, AEMT orthophosphate, and water) is as follows:

Concentrate I: 8.0 ml.
Benzyl alcohol: 5.5 ml.
Potassium bromide: 1.5 g.
Potassium metaborate: 50.0 g.
Sodium sulfite: 1.6 g.
Water q.s. to: 1 liter
Adjust pH to: 10.70

In order to demonstrate the superior characteristics of the new color developing agent, the same was compared with two other developers made from concentrates respectively denominated II and III, the formulations for which are set forth below. The formulations for Concentrates II and III differed from the formulation for Concentrate I in the following respects. The formulation for Concentrate II contained AEMT but in the form of the sesqui-sulfate monohydrate instead of the orthophosphate. The amount of AEMT present was 31% weight per unit volume in contradistinction to Concentrate I which contained AEMT (in the form of an orthophosphate salt) as 50% weight per unit volume. Concentrate II did not include any preservative. Concentrate III, which is a commercially available color developer concentrate, contained as a color developing agent AEMT as a sesqui-sulfate monohydrate as did Concentrate II and in the same concentration as in Concentrate II, but unlike Concentrate II included an antioxidant as a sulfite ion (the sulfite being present as sodium sulfite) in a concentration of 1.3% weight per unit volume. Concentrate II and III were incorporated into working color developer solutions in such a manner that the solutions prepared from Concentrates II and III contained the same concentrations of all ingredients including the amount of AEMT and the amount of sodium sulfite. The formulations for the baths including Concentrates II and III are set forth below.

Working Bath Solution Prepared with Concentrate II

Concentrate II: 14.0 ml.
Benzyl alcohol: 5.5 ml.
Potassium bromide: 1.5 g.
Potassium metaborate: 50.0 g.
Sodium sulfite: 1.6 g.
Water q.s. to: 1 liter
Adjust pH to: 10.70

Working Bath Solution Prepared with Concentrate III

Concentrate III: 14.0 ml.
Benzyl alcohol: 5.5 ml.
Potassium bromide: 1.5 g.
Potassium metaborate: 50.0 g.
Sodium sulfite: 1.4 g.
Water q.s. to: 1 liter
Adjust pH to: 10.70

A fourth concentrate, referred to as IV, was prepared with the following formula to illustrate the use of the invention in the form of an alcoholate.

Orthophosphoric acid (85%): 58.0 g.
AEMT phosphate monomethanolate: 148.0 g.
Water to 200.0 ml.

A working bath solution was prepared with Concentrate IV which was identical to that prepared with Concentrate I except that Concentrate IV was substituted on an equal volume basis for Concentrate I.

The four aforesaid developer solutions using Concentrates I, II, III and IV were substituted for the developers supplied in the color negative process as described by Eastman Kodak Co. for use in the trade. Standard "gray scale" exposures on Kodak Kodacolor film were processed through these four developer solutions. Their densities were determined and found to be essentially photographically equivalent. In this developing process, hereinafter denominated Process A, the development step was carried out with working solutions employing the four freshly prepared concentrates, these constituting controls for testing as to stability in connection with the storing of concentrates for a period of weeks at a temperature substantially above room temperature.

Four identically constituted concentrates, freshly prepared, were placed in full, stoppered amber glass bottles which were stored (aged) at 50° C. for five weeks. At the end of that time working color developer solutions were freshly made up from the four aged concentrates using the same additional compounds in identical amounts to those above mentioned and photographically evaluated in the manner described above and denominated Process B. The red, green and blue density differences for Processes A and B for four steps of an eleven-step [0–3 log E] gray scale exposure are set forth below, thus providing a direct measurement of density differences between a freshly prepared concentrate and a concentrate that has been stored at a high temperature of 50° C. for five weeks.

| | RED | | | | GREEN | | | | BLUE | | | |
|---|---|---|---|---|---|---|---|---|---|---|---|---|
| Step | 1 | 4 | 7 | 11 | 1 | 4 | 7 | 11 | 1 | 4 | 7 | 11 |
| Concentrate with | | | | | | | | | | | | |
| Developer I and IV | −.01 | −.04 | −.04 | −.06 | .00 | −.02 | −.02 | −.04 | +.01 | −.03 | −.04 | −.03 |
| II | +.41 | +.39 | +.38 | +.35 | +.24 | +.30 | +.37 | +.08 | +.19 | +.27 | +.37 | +.12 |
| III | +.06 | +.24 | +.18 | +.04 | +.08 | +.11 | +.08 | −.02 | +.13 | +.07 | +.05 | .00 |

From the foregoing date it is apparent that a concentrate made with the sesqui-sulfate salt of AEMT requires sulfite ions to be present if it is to be usable. The influence of the sulfite ions is seen by the differences between the results obtained with the working color developer baths including Concentrates II and III. However, a working color developer bath containing Concentrate I or Concentrate IV without sulfite in the concentrate demonstrates the distinctly superior stability of Concentrates I and IV after storage at an elevated temperature. Indeed, it has been observed that a working color developer bath containing Concentrate I or IV after storage for several weeks at 50° C. with a considerably higher concentration of AEMT than the above baths containing Concentrates II and III showed distinctly superior stability to the working color developer bath containing Concentrates II and III stored for similar periods of time at similar elevated temperatures.

That the group of phosphate salts listed above of N,N, disubstituted p-phenylenediamines are uniquely advantageous as color developing agents is readily ascertainable from other experimental data which were obtained and which are set forth below.

Various acid salts of N,N, disubstituted p-phenylenediamines other than the phosphate group mentioned above were tested in comparison with the phosphate salts. It will be recalled that the necessary characteristics, inter alia, for a color developing agent are considerable solubility in water and good stability (reproduceable color effects within a small latitude after storage at a high temperature for a protracted period of time) with or without the addition of protective agents such as sulfites, ascorbic acid, etc. to this concentrate.

Solutions of likely salts of N,N disubstituted p-phenylenediamines, and specifically of AEMT, containing 50% by weight AEMT on a free base basis were prepared by neutralizing the free base with slightly more than the stoichiometric amount of acid, i.e. 5% excess. The acids used were orthophosphonic acid, pyrophosphonic acid, polyphosphonic acid, nitrilo triphosphonic acid, ethylenediamine tetraphosphonic acid, acetic acid, hydroxyacetic acid, citric acid, gluconic acid, malic acid, formic acid, hypophosphorous acid and orthophosphorous acid.

It was found that with the organophosphonic acids such as nitrilo trimethylenephosphonic acid, ethylenediamine tetramethylenephosphonic acid and like acids, the AEMT salts thereof when incorporated into water as a solution became very viscous at a 30% or greater concentration weight per unit volume and, hence, were not commercially useful, the concentration being too low for desirable practical use.

Certain other of the AEMT salts decomposed either immediately upon formation thereof or shortly after storage at 50° C. and thus were of no further interest. For example, the formate salt of AEMT decomposed immediately. The hypophosphite and phosphite salts of AEMT decomposed after a day or two of stoppered storage at 50° C. with evolution of hydrogen sulfide.

Other salts of AEMT showed poor photographic effects which appeared to be due to the anionic constituent. For example, a working color developer bath made with the acetate salt of AEMT had inferior photographic effects colorwise when compared to a working color developer bath made with either a sulfate or a phosphate salt of AEMT. Even discounting the initial difference in photographic response, many of the salts of organic acids other than the phosphates of the present invention showed considerable instability upon prolonged storage at 50° C. The method of testing the sundry N,N disubstituted p-phenylenediamine salts of the acids that did not perform well, as well as the salts of the phosphoric acids that did and do perform well, was as follows:

A concentrate of the desired salt was prepared by adding the stoichiometrically required amount of the acid for neutralization plus an excess of about 5% and diluting the same with water to about 100 ml., then dissolving 100 g. of AEMT in the solution and diluting with water to 200 ml., all at ambient temperature and pressure. For neutralization it was calculated that each mole of AEMT required three moles of monobasic acid and equivalently less of polybasic acids.

The concentrate so prepared contained 50% weight per unit volume of AEMT. The concentrates of the various acids were stored at 50° C. in stoppered amber glass bottles for periods ranging from 8 to 21 days. Concentrates were stored with and without a small amount of sodium bisulfite as a preservative, the small amount being 0.4% by weight of the AEMT content. After the above storage the various concentrates were incorporated in a working color developer bath which included in addition to the concentrate the further compounds and materials listed in connection with the above described working color developer bath containing Concentrate I with the exception that some of the baths contained sodium sulfite and others did not, such difference being pointed out below. Where sodium sulfite was employed it was present in the amount previously mentioned, i.e. 0.4% by weight of sodium sulfite of the AEMT content, the incorporation being for preservation purposes. For a standard, i.e. control, a working color developer bath was made which was the same as that given above for Concentrate I except that said concentrate was replaced by 6.4 g. of AEMT sesqisulfate monohydrate. Both the bath prepared with Concentrate I and the standard contained the same amount of AEMT on a free base basis.

The developers were then incorporated into the Kodak Kodacolor process in the manner described by Eastman Kodak Co. for use in the trade and said developers were employed to develop Kodak Kodacolor film. The sequence and times in a complete developing process were as follows:

| | |
|---|---|
| Developer | 14 minutes |
| Stop | 4 minutes |
| Harden | 4 minutes |
| Wash | 4 minutes |
| Bleach | 6 minutes |
| Wash | 4 minutes |
| Fix | 8 minutes |
| Wash | 8 minutes |
| Wetting agent dip | |
| Dry | |

All solution temperatures were 75° F. The gray scale exposures, make on Kodak Kodacolor film after processing the above using the working color developer bath as determined by conventional densitometry, had certain red, green and blue densities. Table I set forth below lists the concentrates tested (with the exception of phosphates according to the present invention) and the variations tried.

Table II set forth below shows the density differences between the concentrates tested and the fresh standard developer mentioned above for red, green and blue densities on the first, fourth, seventh and eleventh steps of eleven-step [0–3 log E] gray scale exposures after processing.

Table III set forth below lists concentrates tested of AEMT phosphate salts embodying the invention with variations in concentration of acid from that just needed for neutralization and with and without an amount of sodium bisulfite equal to 0.4% by weight of the AEMT present.

Table IV set forth below is similar to Table II but shows the differences between the red, green and blue densities between those obtained using developer with the concentrate of Table III and those obtained using the control developer. The density differences are those measured for the first, fourth, seventh and eleventh steps of eleven-step [0–3 log E] gray scale exposure after processing. In all cases for Tables III and IV, the concentrates were stored at a temperature of 50° C. in a stoppered amber glass bottle for periods as indicated in Table III.

TABLE I

| Concentrate | Description of Concentrate |
|---|---|
| A | AEMT neutralized with acetic acid. Tests were run with sodium bisulfite present as a preservative and also with sodium bisulfite omitted. In every instance where sodium bisulfite was omitted density differences were larger than indicated in Table II. The AEMT acetate was stored for 8 days. |
| B | AEMT neutralized with hydroxy acetic acid. Tests were run with sodium bisulfite present as a preservative and also with sodium bisulfite omitted. In every instance where sodium bisulfite was omitted density differences were larger than indicated in Table II. The AEMT hydroxy acetate was stored for 8 days. |
| C | AEMT neutralized with citric acid. Tests were run with sodium bisulfite present as a preservative and also with sodium bisulfite omitted. In every instance where sodium bisulfite was omitted density differences were larger than indicated in Table II. The AEMT citrate was stored for 8 days. |
| D | AEMT neutralized with gluconic acid. Tests were run with sodium bisulfite present as a preservative and also with sodium bisulfite omitted. In every instance where sodium bisulfite was omitted density differences were larger than indicated in Table II. The AEMT gluconate was stored for 8 days. |
| E | AEMT neutralized with malic acid. Tests were run with sodium bisulfite present as a preservative and also with sodium bisulfite omitted. In every instance where sodium bisulfite was omitted density differences were larger than indicated in Table II. The AEMT malate was stored for 8 days. |

TABLE II

| Developer | RED | | | | GREEN | | | | BLUE | | | | |
|---|---|---|---|---|---|---|---|---|---|---|---|---|---|
| Concentrate | 1 | 4 | 7 | 11 | 1 | 4 | 7 | 11 | 1 | 4 | 7 | 11 | Step |
| A | −.02 | −.05 | −.09 | −.12 | −.08 | −.10 | −.10 | −.08 | −.04 | −.06 | −.07 | −.04 | |
| B | −.09 | −.22 | −.27 | −.45 | −.12 | −.15 | −.12 | −.08 | −.09 | −.24 | −.31 | −.29 | |
| C | −.04 | −.04 | −.06 | −.08 | +.05 | +.06 | +.06 | +.08 | −.02 | −.02 | −.03 | .00 | |

TABLE II-continued

| Developer | RED | | | | GREEN | | | | BLUE | | | | |
|---|---|---|---|---|---|---|---|---|---|---|---|---|---|
| Concentrate | 1 | 4 | 7 | 11 | 1 | 4 | 7 | 11 | 1 | 4 | 7 | 11 | Step |
| D | −.12 | −.30 | −.50 | −.79 | −.39 | −.49 | −.58 | −.50 | −.18 | −.35 | −.55 | −.51 | |
| E | −.07 | −.14 | −.16 | −.24 | −.17 | −.26 | −.22 | −.15 | −.09 | −.15 | −.11 | −.14 | |

TABLE III

| Concentrate | Description of Concentrate |
|---|---|
| F | AEMT neutralized with orthophosphoric acid. No bisulfite was used. The AEMT orthophosphate was stored for 21 days. |
| G | The same as F except that the acid content was doubled. |
| H | AEMT neutralized with pyrophosphoric acid. No bisulfite was used. The AEMT pyrophosphate was stored for 21 days. |
| J | AEMT neutralized with polyphosphoric acid containing the equivalent of 115% orthophosphoric acid. The AEMT polyphosphate was stored for 21 days. |
| K | The same as J except that the acid content was doubled. |

TABLE IV

| Developer | RED | | | | GREEN | | | | BLUE | | | | |
|---|---|---|---|---|---|---|---|---|---|---|---|---|---|
| Concentrate | 1 | 4 | 7 | 11 | 1 | 4 | 7 | 11 | 1 | 4 | 7 | 11 | Step |
| F | −.01 | −.03 | −.04 | −.07 | −.02 | −.05 | −.05 | −.04 | −.08 | −.09 | −.06 | −.02 | |
| G | −.03 | −.04 | −.03 | −.04 | −.01 | −.03 | −.03 | −.03 | −.04 | −.07 | −.07 | −.03 | |
| H | .00 | −.01 | −.02 | −.01 | −.02 | −.01 | −.01 | −.02 | −.03 | −.05 | −.06 | −.08 | |
| J | −.01 | −.03 | −.05 | −.06 | −.01 | −.01 | .00 | +.02 | −.06 | −.09 | −.09 | −.05 | |
| K | −.01 | −.02 | −.03 | −.04 | .00 | .00 | −.01 | +.01 | −.05 | −.09 | −.06 | −.03 | |

The tests were repeated with the concentrates used in the developers of Table III but additionally incorporating in the concentrates, as a preservative, 0.4% by weight of sodium bisulfite based on the AEMT. The density differences obtained with such variation were even smaller than those indicated in Table IV.

Using concentrates F, G, H, J and K, with and without sodium bisulfite it was difficult, due to the small differences in density, to assess whether these differences truly represented a change in photographic response caused by the change in the anion or whether the numbers simply represented a random variation that normally would be present in a test of this sort. The entire spread between the differences for any particular one of these concentrates and the standard or between any different ones of these concentrates and the standards were so small as to be statistically insignificant.

Three further concentrates were tested employing alcoholates of AEMT orthophosphate, the preparation of which is disclosed in the aforesaid application Serial No. The three alcoholates were, respectively, ethyl alcoholate, n-propyl alcoholate and isopropyl alcoholates of AEMT orthophosphate. Baths prepared with these latter concentrates using the formulation indicated above with respect to Concentrate I and employed for developing Kodak Kodacolor film by the same process as described with respect to Concentrate I yielded gray scale exposure results statistically indistinguishable from the gray scale exposure results obtained with a similar solution prepared using Concentrate I, both when freshly made and when stored for 21 days in a stoppered amber glass bottle. The methyl alcoholate test results were described above.

It thus will be seen that there are provided methods, compounds, compositions and concentrates which achieve the several objects of the invention and which are well adapted to meet conditions of practical use.

As various possible embodiments might be made of the above invention, and as various changes might be made in the embodiments above set forth, it is to be understood that all matter herein described is to be interpreted as illustrative and not in a limiting sense.

Having thus described the invention there is claimed as new and desired to be secured by Letters Patent:

1. A stable color developer concentrate essentially consisting of a concentrated water solution of a 4-amino-N-ethyl, N-beta methanesulfonamidoethyl-[n]m-toluidene salt of a phosphoric acid selected from the group consisting of orthophosphoric acid, pyrophosphoric acid and polyphosphoric acid containing the equivalent of from about 105% to about 115% orthophosphoric acid, said salt being present in an amount such that the 4-amino-N-ethyl, N-beta methanesulfonamidoethyl-[n]m-toluidene constitutes from 50% to 65% weight per unit volume of the concentrate.

2. A concentrate such as set forth in claim 1 wherein the N,N, disubstituted p-phenylenediamine phosphate is an orthophosphate.

3. A concentrate such as set forth in claim 1 wherein the N,N, disubstituted p-phenylenediamine phosphate is a pyrophosphate.

4. A concentrate such as set forth in claim 1 wherein the N,N, disubstituted p-phenylenediamine phosphate is a polyphosphate.

5. A concentrate such as set forth in claim 1 wherein the N,N, disubstituted p-phenylenediamine phosphate is polyphosphate containing the equivalent from about 105% to about 115% orthophosphoric acid.

6. A concentrate such as set forth in claim 1 wherein the N,N, disubstituted p-phenylenediamine salt is an alcoholate of an orthophosphate, of which the alcohol is selected from the group consisting of methyl, ethyl, n-propyl and isopropyl alcohols.

7. A concentrate such as set forth in claim 1 wherein the N,N, disubstituted p-phenylenediamine salt is a methanolate of an orthophosphate.

* * * * *